United States Patent [19]

Matheson et al.

[11] Patent Number: 4,616,978

[45] Date of Patent: Oct. 14, 1986

[54] FLUID SUPPLY SURGE CONTROL SYSTEM

[75] Inventors: Ronald R. Matheson, Utica; Daniel E. Hucul, Bloomfield Hills, both of Mich.

[73] Assignee: Auto/Con, Roseville, Mich.

[21] Appl. No.: 700,494

[22] Filed: Feb. 11, 1985

[51] Int. Cl.[4] ..... F04B 49/02; F04B 49/08; B67D 5/00

[52] U.S. Cl. ..... 417/2; 417/286; 417/26; 222/64; 222/66; 222/135

[58] Field of Search ..... 417/2-8, 417/26, 286; 222/64, 66

[56] References Cited

U.S. PATENT DOCUMENTS

| | | | |
|---|---|---|---|
| 2,797,846 | 7/1957 | Reed | 417/7 |
| 3,292,547 | 12/1966 | Ward | 417/7 |
| 3,860,363 | 1/1975 | Silvern | 417/26 |
| 4,247,018 | 1/1981 | Credle | 222/64 |
| 4,389,001 | 6/1983 | Franklin | 222/66 |
| 4,435,127 | 3/1984 | Kranzle | 417/26 |
| 4,467,941 | 8/1984 | Du | 222/66 |
| 4,476,889 | 10/1984 | Haynes | 417/26 |
| 4,544,328 | 10/1985 | Credle | 222/66 |

FOREIGN PATENT DOCUMENTS

| | | | |
|---|---|---|---|
| 880829 | 10/1961 | United Kingdom | 417/2 |

*Primary Examiner*—William L. Freeh

*Attorney, Agent, or Firm*—Harness, Dickey & Pierce

[57] ABSTRACT

A surge control fluid delivery system is described particularly adapted for pumping of high-viscosity substances from a reservoir for dispensing. The system includes a manifold which is connected to an outlet line of a pump. A vent circuit for returning fluid from the manifold to the reservoir is also provided. Surge control is achieved through a control system which modulates the fluid supply pump and further activates a valve in the vent return line to maintain the pressure of the fluid within the manifold to within adjustable upper and lower limits. The system further includes means for automatically switching from one source of fluid to another upon depletion of the first source.

38 Claims, 9 Drawing Figures

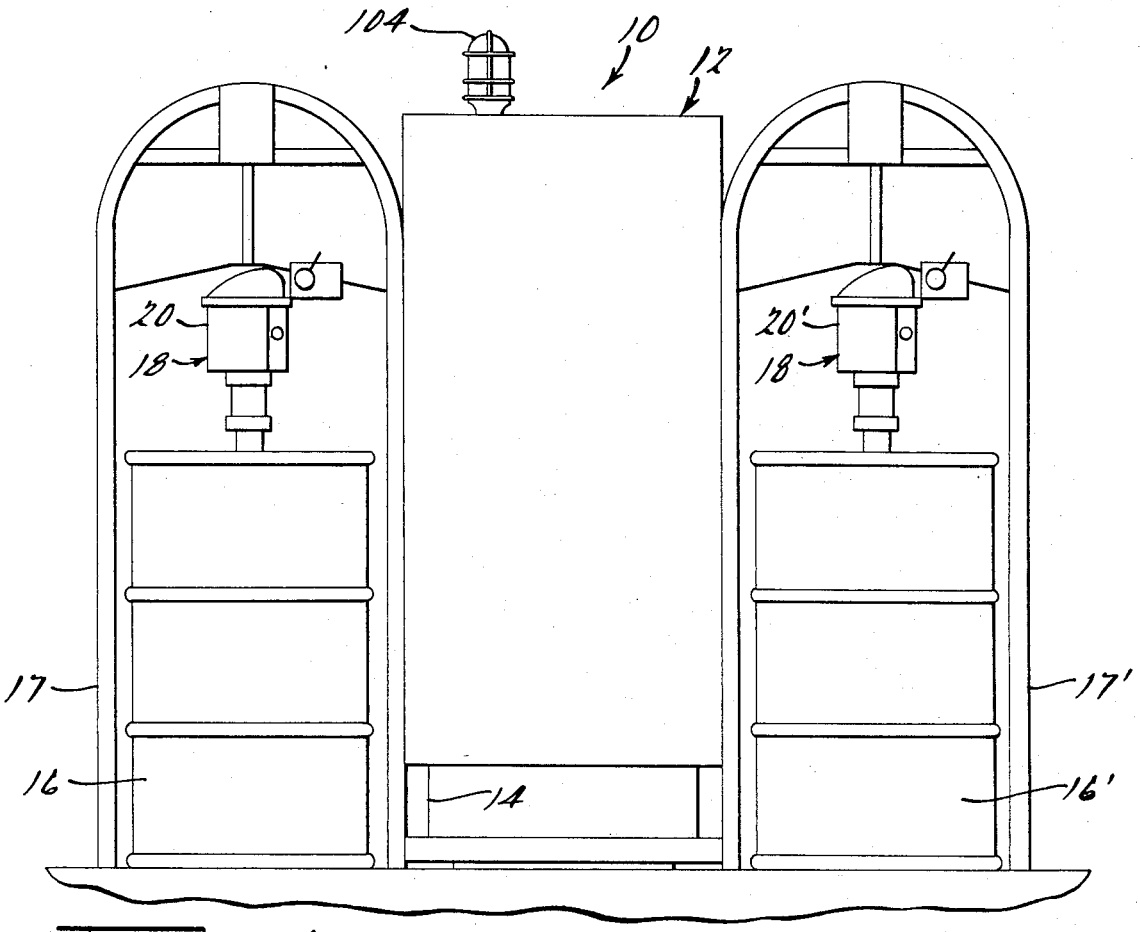
FIG. 1.
FIG. 4.
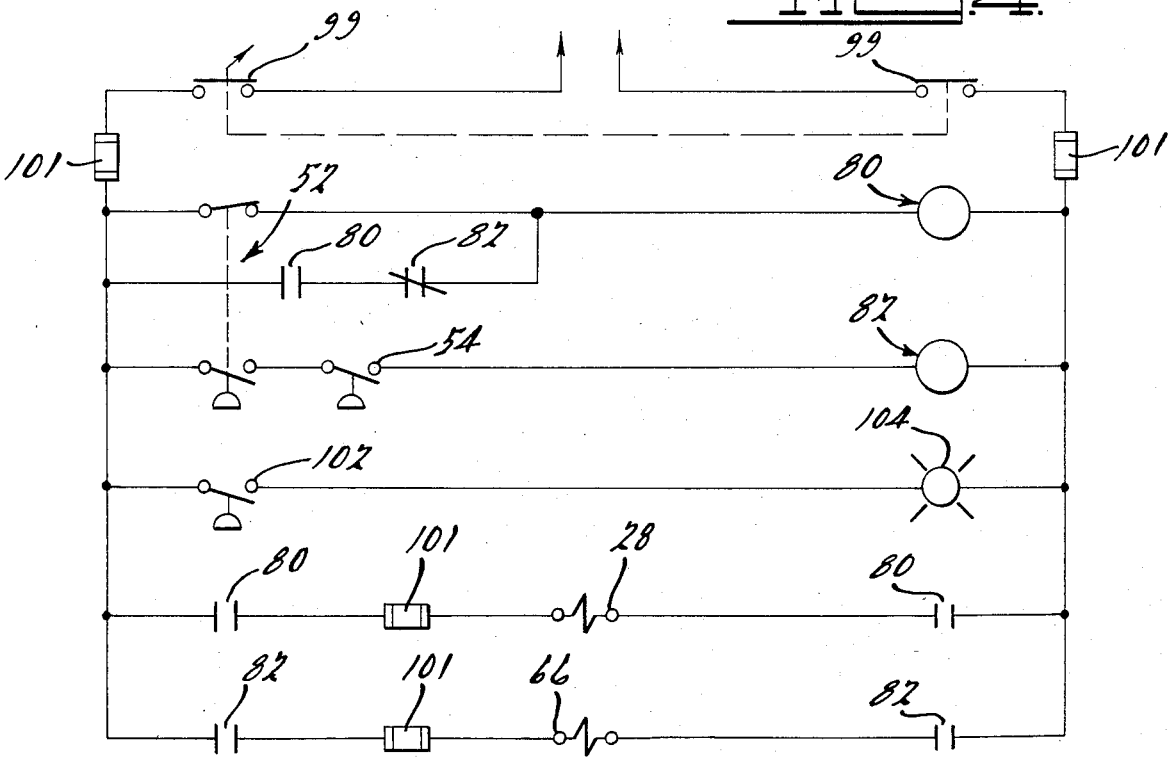

104
112
37
26
94
12
98
64
86
24
114
86
24'
92
92'
96
54
52
50
78
78'
84
70
70'
62
108
108'
106'
40
110
106
38
38'
36
36'
34
34'
14

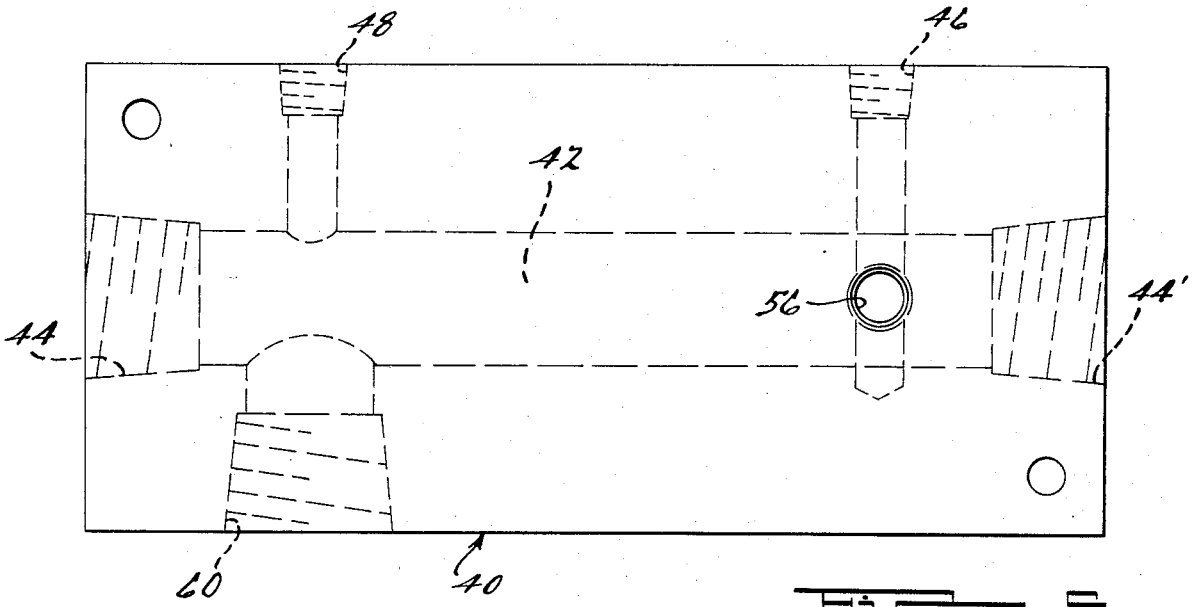
FIG. 5.
FIG. 6.
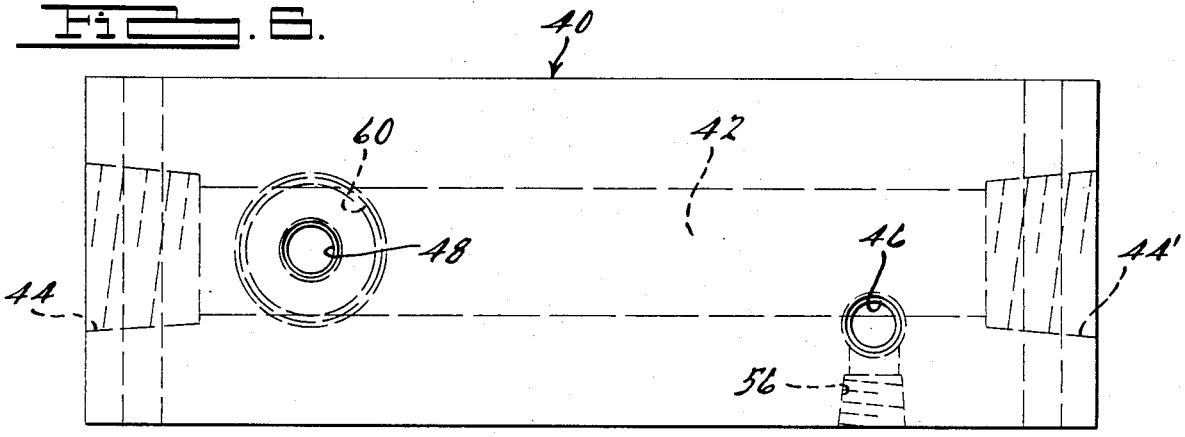
FIG. 7.
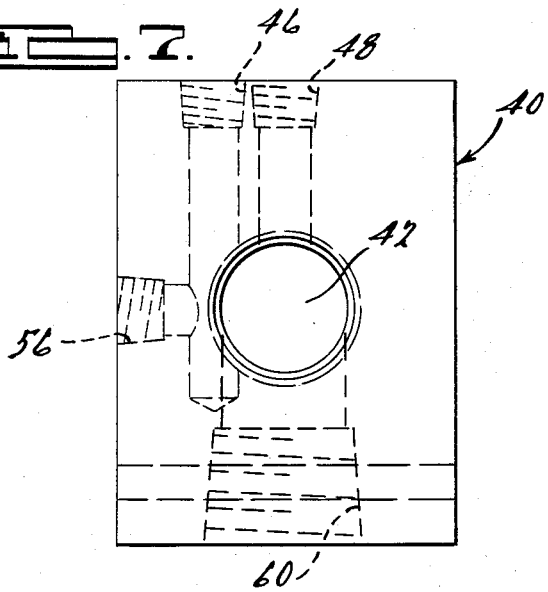
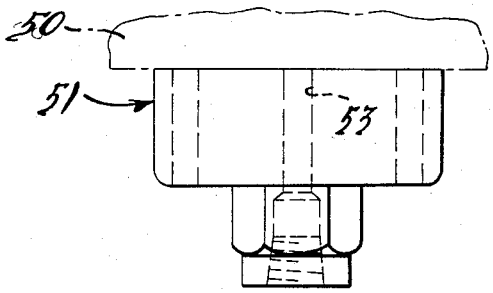
FIG. 8.
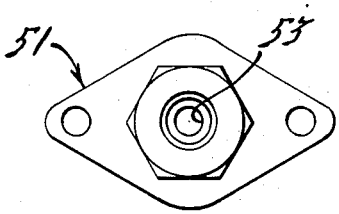
FIG. 9.

FLUID SUPPLY SURGE CONTROL SYSTEM

BACKGROUND OF THE INVENTION

This invention relates to a fluid supply system which provides supply pressure regulation and particularly, to such a system adapted to deliver high viscosity fluids such as sealant materials to a dispensing apparatus.

During assembly of motor vehicle body components and other devices, it is frequently necessary to apply beads of high viscosity fluids such as sealants which are often placed within body component seams and other locations to provide sound deadening, bonding, and/or corrosion resistance. These substances are either dispensed manually by an operator or by automated dispensing guns. In order to properly dispense such materials, very great supply pressures are required. Fluid supply systems for such applications are presently known. These devices, however, suffer a significant shortcoming in that they are unable to regulate the pressure at which the fluid is supplied to within a narrow range. Instead, significant fluid pressure fluctuations occur which can lead to inexact fluid dispensing metering. Moreover, the physical characteristics of some fluids such as certain industrial sealants are known to change significantly in response to variations in their hydrostatic pressure. Some of these substances undergo substantial viscosity changes with applied pressure which further aggravates metering consistency problems, and can further lead to sealant sputtering and plugging.

In addition to controlling fluid pressure in a fluid supply system used for dispensing sealants and other materials, it is further desirable to provide such an apparatus with a dual supply of fluids, thereby enabling replenishment of one supply while another is drawn. Such dual fluid supplies permit the device to operate continuously without interruption despite depletion of one fluid supply.

In view of the above, it is a principal object of this invention to provide a fluid supply system capable of supplying high viscosity fluids at supply pressures which are maintained within a desired range of pressures. It is a further.object to enable the range of supply pressure to be adjustable. It is a further object of this invention to provide such a system which is capable of drawing fluid from two or more fluid reservoirs and which automatically switches to an alternate fluid source when one becomes depleted. It is yet another object of this invention to provide a system overcoming the previously-metioned shortcomings according to the prior art which may be constructed from readily available components.

SUMMARY OF THE INVENTION

The above objects of this invention are achieved by employing a fluid supply system wherein pressurized fluid is supplied to a manifold component. The manifold has high and low pressure switches attached thereto which constantly monitor fluid pressure within the manifold. When the set threshold pressure of the low pressure switch is reached, the fluid supply pump is energized, thereby forcing additional fluid in the manifold and increasing fluid pressure. When the set threshold pressure of the high pressure switch is reached within the manifold, a vent circuit is actuated which recirculates the pumped fluid back to the source, thereby dumping it and reducing pressure within the manifold. By properly adjusting the high and low pressure switches, the pressure of the supplied fluid drawn from a port of the manifold is maintained between upper or lower limits, creating a "deadband" of supply pressure. The deadband limits are selected to avoid the above-mentioned undesirable results of wide pressure fluctuations.

Additionally, a fluid supply circuit is provided which acts as an alternate source of working fluid. A supply switching circuit is also described which automatically switches the source of fluid from a first source to a second source in response to depletion of the first source. This circuit also includes a mechanism for changing the path of fluid venting (provided for pressure regulation) to the source which is being used to provide working fluid.

The fluid supply system according to this invention performs the above-described functions automatically through employing pneumatic and electrically actuated valve and switch mechanisms, thereby avoiding the necessity for continuous operator monitoring and control. This system is therefore well-suited for use with highly-automated manufacturing systems.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 1 is front elevational view of the fluid supply surge control system in accordance with this invention shown connected to a pair of fluid supply barrels and further showing fluid supply pumps for each barrel;

FIG. 4 is an electrical circuit diagram for the device according to this invention;

FIG. 5 is a front elevational view of the manifold component employed in connection this invention;

FIG. 6 is a top elevational view of the manifold shown in FIG. 5;

FIG. 7 is an end view in elevation of the manifold shown in FIG. 5;

FIG. 8 is a partial elevational view of a fitting for the dual pressure switch used in accordance with this invention; and FIG. 9 is an end elevational view of the fitting shown in FIG. 8.

DETAILED DESCRIPTION OF THE INVENTION

Figure 2:
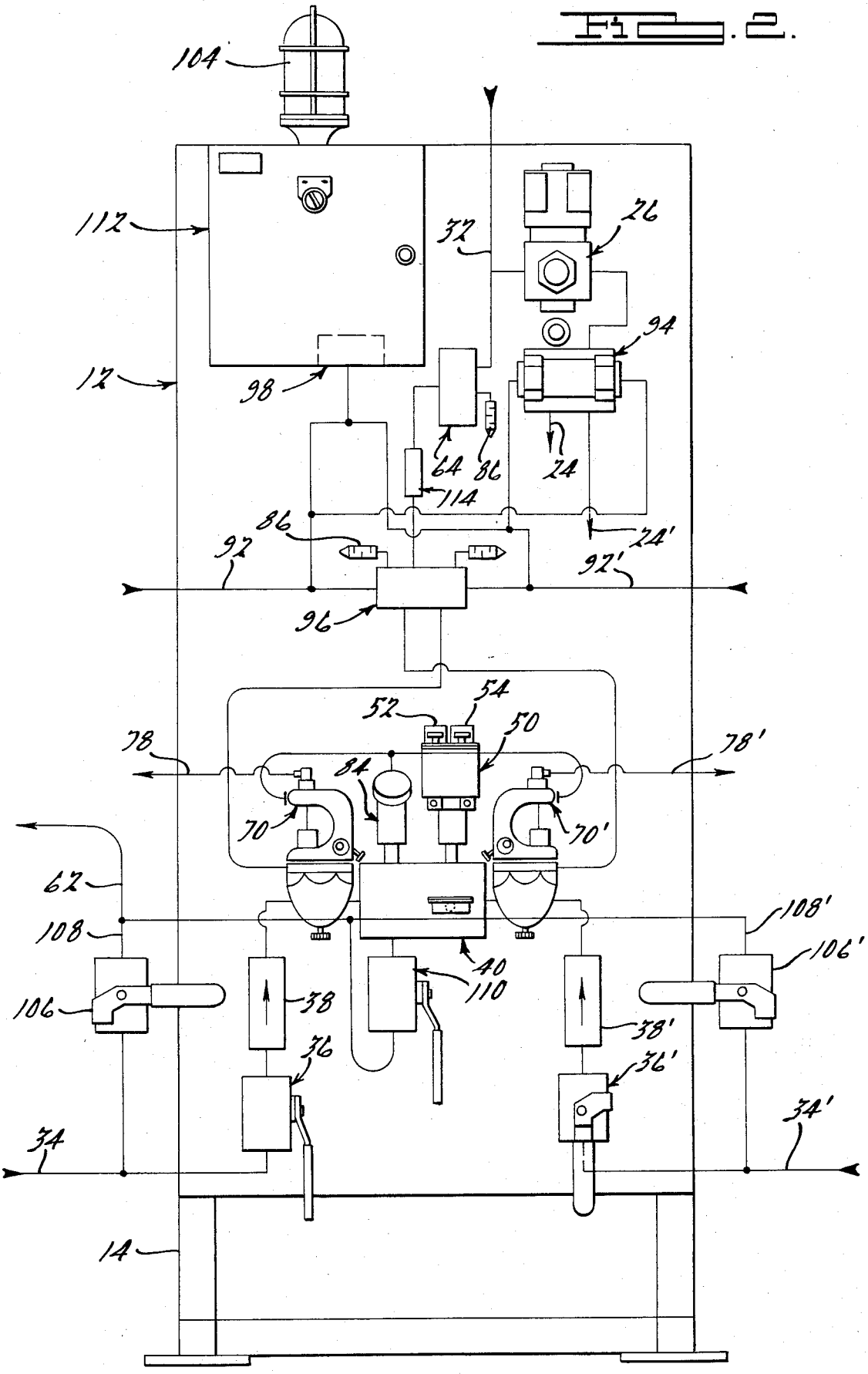
FIG. 2 is a front elevational view of the fluid supply surge control system according to this invention showing the various components therein and illustrating the connecting conduits schematically.

A fluid supply surge control system in accordance with this invention is shown in FIG. 1 and is generally designated there by reference number 10. The system shown by the Figures is particularly adapted for supplying high-viscosity sealants such as those used in motor vehicle production for corrosion protection, bonding and sound deading. The system 10 has, however, much broader application in dispensing of other fluids; sealant materials are described for illustrative purposes only. The fluid supply system 10 has components which are attached to a chassis 12 and a stand 14. As shown by FIG. 1, a pair of barrels 16 and 16' are provided as sources of working fluid. Each of the barrels 16 and 16' fit within a pair of stands 17 and 17'. The stands 17 and 17' provide a stable mounting structure for the barrels 16 and 16' and also may be used as a mount for a pair of pump assemblies 18 and 18'. As will be subsequently described in greater detail, when either of the barrels 16 or 16' becomes depleted of working fluid, the system 10 automatically switches to another barrel to provide a continuous supply of working fluid.

Figure 3:
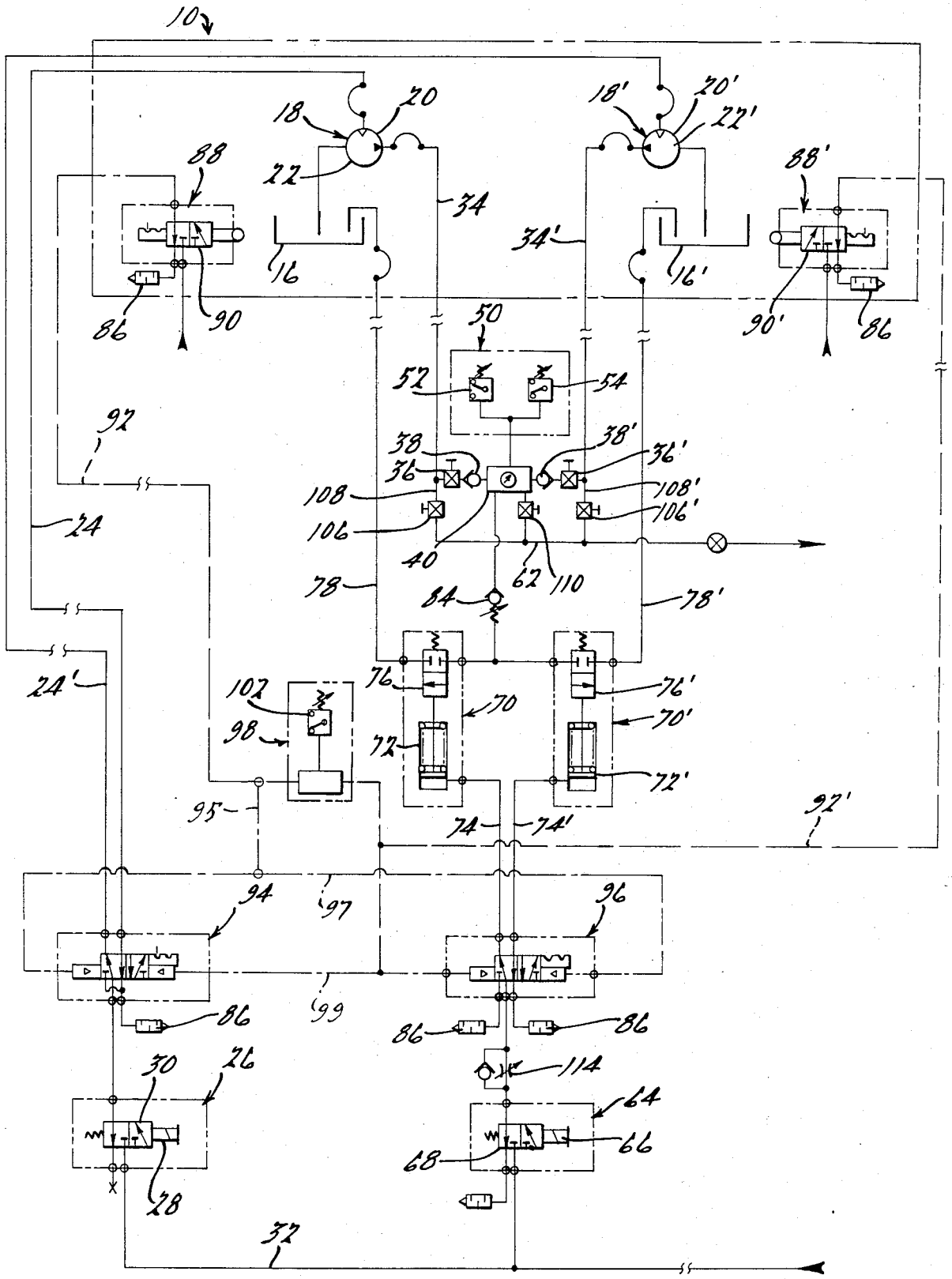
FIG. 3 is a schematic diagram of the fluid supply surge control system in accordance with this invention showing all of the fluid actuated mechanisms and interconnecting conduits.

FIGS. 2 and 3 illustrate the individual components of the fluid supply surge control system 10. FIG. 2 shows a preferred layout for the components on the chassis 12, whereas FIG. 3 is a schematic diagram of the entire fluidic circuit of the system 10. Now with particular reference to FIG. 3, the components and connections within the system 10 will be described in detail. The details of the system 10 will begin with a description of the surge control system, and will be then followed with a description of the supply switching circuit and manual actuation circuit according to this invention. These functional subparts of the system 10 are described in the following separately captioned subsections.

SURGE CONTROL SYSTEM

The description of the surge control system will be made with reference to a single source of working fluid. The components relating to the system for supplying fluid from one source are designated by unprimed reference numbers. Primed reference numbers are used to designate identical components of the system for drawing fluid from another source. The second system for supplying fluid is a mirror image of the first and therefore a description of the first will suffice for both. The diagrams of FIGS. 2 and 3, however, are complete in that components of each of the systems are duplicated and the connections between elements are shown for all of the components.

The pump assembly 18 is provided for pumping working fluid from the barrel 16. The pump assembly 18 includes an air-driven pump motor 20 which drives a pump 22 (not shown) which is preferably submersed within the fluid being pumped from within the barrel 16. Due to the relatively high delivery pressures required, it is further preferred to employ a positive displacement pump, such as a gear pump. Since the pump 22 is driven by the pump motor 20, the pressure of the delivered fluid is controllable by modulating and/or intermittently supplying pneumatic pressure for driving the pump motor 20. Pneumatic pressure is supplied to the pump motor 20 by a pump air supply conduit 24 which is controlled through actuation of a pump control switch 26 which includes a pump control switch solenoid 28 and a pneumatic three-way pump control switch valve 30. A source of air pressure is provided to the valve 30 by an air supply conduit 32. The solenoid 28, upon energization, changes the state of the pump control switch valve 30 to open or close the supply of pressurized air from the air supply conduit 32 to the pump air supply conduit 24, thereby selectively energizing or de-energizing the pump assembly 18.

When the pump assembly 18 is energized to deliver fluid, fluid from within the barrel 16 is forced to flow under pressure into a pump outlet conduit 34. Thereafter, working fluid is conducted through a manually controllable ball valve 36 and through a check valve 38 into a manifold 40. The details of the manifold 40 are shown in detail in FIGS. 5, 6 and 7. The manifold 40 defines a plurality of ports, each communicating with a common interior chamber 42. A diameter of the manifold interior chamber 42 of approximately one inch has been found satisfactory. The fluid discharged from the check valve 38 flows into the chamber 42 via a port 44. An outlet port 46 of the manifold 56 communicates with a dual pressure switch 50. A working prototype of the system 10 has been fabricated which employs valve number C-9622-3 sold by the Barksdale Controls Division of Transamerica Delaval Inc. for the dual pressure switch 50. The Barksdale valve was, however, modified to improve system performance. A partial side view of the Barksdale valve is shown in FIG. 8 which shows particularly the standard connection fitting 51. It was found that the responsiveness of the pressure switch 50 was enhanced by enlarging the fitting bore 53, best shown in FIG. 9, to a diameter of 0.1875 inch. By enlarging the bore 53, less fluid resistance occurs therethrough, enabling the pressure switch 50 to more accurately sense the fluid pressure within the manifold 40. Further, it was found that the dual pressure switch 50 is prferably directly connected to the manifold 40 or connected thereto by conduit having a length of three inches or less. Longer lengths of connecting conduit were found to adversely affect responsiveness of the system. The switch 50, in fact, is connected as close as possible to the manifold 40 in the preferred embodiment of the invention. Another manifold port 56 is provided to enable a visual pressure gage 58 to be mounted to the manifold 40. An outlet port 60 conducts fluid to an outlet conduit 62. The dual pressure switch 50 has a pair of individual pressure switches, a low pressure switch 52 and a high pressure switch 54. These pressure switches change state in response to adjustable high or low fluid pressures existing within the manifold 40. The pressure switches 52 and 54 provide an electrical output when their adjusted switching threshold pressure is reached.

The manifold 40 further defines a vent port 48 which conducts fluid into a vent return conduit 78 providing a means for conducting working fluid back to its source when the pressure within the manifold 40 exceeds a predetermined value. A vent control switch 64 is connected to the air supply conduit 32 and includes a vent control switch solenoid 66 and a pneumatic three-way vent control switch valve 68. The vent control switch 64 acts to controllably supply high-pressure air from the air supply conduit 32 to a pump vent control valve 70. The pump vent control valve 70 includes a cylinder 72 which responds to the existence of pneumatic pressure within a vent conduit 74 to actuate a fluid valve 76. A flow control valve 114 in the conduit 74 prevents excessively rapid actuation of the cylinder 72. The fluid valve 76 opens or closes the passageway within the vent return conduit 78. Opening of the pump vent control fluid valve 76 allows working fluid within the manifold 40 to be vented back to the barrel 16. An adjustable restriction check valve 84 is installed within the vent return conduit 78 to provide a desired level of backpressure during fluid venting. Many of the previously described pneumatic valves in the system 10 include mufflers 86 which reduce undesirable air blasting upon venting of high air pressure to the atmosphere.

An electrical circuit diagram for the system 10 is shown in FIG. 4. As shown, the dual pressure switch 50, which includes the low and high pressure switches 52 and 54, respectively, controls operation of a first and a second control relay 80 and 82. Each of the control relays 80 and 82 have multiple contacts, as indicated in FIG. 4. Actuation of the high-pressure switch 54 causes the second control relay 82 to actuate the vent control switch solenoid 66, thereby venting fluid to its source. Similarly, actuation of the low-pressure switch 52 causes actuation of the pump control switch solenoid 28 and opens the circuit to vent control switch solenoid 66. Power is provided to the circuit as designated by the arrows in the top portion of FIG. 4. A main power switch 99 is provided to actuate or deactuate the circuit. Current limiting fuses 101 are provided at several points in the circuit for component overcurrent protection.

As stated previously, an additional pump assembly 18' is also provided along with elements identified by reference numbers with prime subscripts which are identical to those previously described and which are interconnected in the same manner. The second pump supply system is connected to the manifold port 44'. The circuit and control system for changing the source of working fluid from one source to another will be described hereinafter.

The operation of the surge control system will now be described in detail. When air pressure becomes available within the air supply conduit 32, air is directed to the pump motor 20 which causes fluid pumping and allows pressure of the working fluid to be built up within the manifold 40. The fluid pressure within the manifold 40 is continuously monitored by the low and high pressure switches 52 and 54. When the pressure within the manifold 40 reaches the switching threshold of the high-pressure switch 54, the second control relay 82 activates the vent control switch solenoid 66 to cause actuation of the vent control switch valve 68 to provide fluid flow through the vent conduit 78, thereby returning material to the barrel 16. The state of the components remains in this condition until the fluid pressure within the manifold 40 drops off due to material venting or material discharge. Once the fluid pressure in the manifold 40 drops to the switching threshold of the low-pressure switch 52, the first control relay 80 causes the pump control switch solenoid 28 to switch the valve 30, thereby re-energizing the pump motor 20. Actuation of the low pressure switch 52 further opens the circuit to the second control relay 82, thereby de-energizing the vent control switch solenoid 66. The pressure of supplied fluid therefore varies between the limits established by the adjusted pressure sensitivity of the low and high pressure switches 52 and 54. This creates a "deadband" or range in the pressure variations of supplied fluid. Preferably, the pressure switches 52 and 54 are adjustable to permit variation in this deadband condition. A sufficient difference in the high and low pressure adjustments is desirable to prevent excessive and rapid system cycling, yet providing the fluid supply pressure within a desired range. An adjustable check valve 84 is set to provide a resistance to flow of the vented working fluid to prevent excessively rapid pressure drop in the manifold 40 during venting. The check valve 84 should be adjusted up to a pressure high enough to be the low end of the deadband range.

SUPPLY SWITCHING CIRCUIT

As previously stated, the fluid supply surge control system 10 according to this invention provides for dual sources of working fluid and further includes a system for switching between these sources automatically upon one source becoming depleted. The components and operation of this supply switching will now be described in detail.

A pair of pilot valves 88 and 88' are positioned within the barrels 16 and 16' and sense the presence of pressurized fluid being pumped by the pumps 22 and 22'. A low-pressure air signal is provided to inlet ports of each of the pilot valves 88 and 88'. The pilot valves include a three-way pneumatic valve 90 and 90' which opens or closes the air pressure source to pilot signal lines 92 and 92'. A four-way pneumatic shuttle pump selector valve 94 is provided which responds to fluid pressure exerted through either of the pilot signal lines 92 and 92' via lines 95 and 97 or line 99, respectively. The position of the pump selector valve 94 determines which of the pump motors 20 or 20' receive an air pressure signal from the pump control switch 26. Therefore, the pump selector valve 94 determines which source of working fluid acts to supply fluid to the system 10.

A four-way pneumatic shuttle material vent valve 96 is also connected to the pilot signal lines 92 and 92' via lines 95 and 97 or line 99, respectively, and, like the valve 94, changes position in response to signals from the pilot valves 88 and 88'. The material vent valve 96 insures that material is directed to the same barrel 16 or 16' which is being used as a source of working fluid.

As an additional feature, the user is provided with a visual and/or audible indication that one of the barrels 16 or 16' has become emptied through the action of a pneumatic shuttle empty drum indicator switch 98. The switch assembly 98 has a pair of inlets connected to each of the pilot signal lines 92 and 92'. If pressure is applied to either port of the switch 98, a pressure switch 102 is activated which changes the position of the switching element, which is used to provide a visual indication of a lack of working material in either of the barrels. With reference to the electrical circuit diagram of FIG. 4, the pressure switch 102 is shown in a circuit branch to control drum empty warning light 104.

MANUAL ACTUATION CIRCUIT

A number of manually actuated ball-type control valves are provided which enable the surge control subsystem of the system 10 to be rendered inoperative, permitting the manual dispensing of fluid from the system 10. Further, these valves are provided to enable individual components of the system 10 to be deactivated to permit component testing or replacement. Ball valves 106 and 106' are provided in bypass conduits 108 and 108' which bypass the manifold 40 to permit fluid discharge from either of the pumps to be conducted directly into the discharge outlet line 62. Ball valve 110 is provided within the discharge outlet line 62. During normal operation of the system 10, valves 36, 36' and 110 are opened, and valves 106 and 106' are closed. Manual operation is provided by closing valves 36, 36' and 110, and selectively opening one or both of valves 106 and 106'.

A preferred physical layout of the components of the system 10 on the chassis 12 is shown in FIG. 2. An electrical circuit chassis 112 is provided to house the electricl components and further provides a mounting location for the warning light 104 attached to the upper portion thereof.

While the above description constitutes the preferred embodiments of the present invention, it will be appreciated that the invention is susceptible to modification, variation and change without departing from the proper scope and fair meaning of the accompanying claims.

What is claimed is:

1. A fluid supply system for controlling the pressure of fluid delivered from a fluid reservoir, comprising:

means for pumping the fluid from the reservoir, a manifold, pump outlet means communicating said pumping means with said manifold, outlet means communicating with said manifold for discharging the fluid, vent return means communicating said manifold with the reservoir for returning the fluid from said manifold to the reservoir, high pressure sensing means communicating with said manifold, said high pressure sensing means having a sensing threshold, low pressure sensing means communicating with said manifold, said low pressure sensing means having a sensing threshold which is less than said sensing threshold of said high pressure sensing means, control means for said pumping means for energizing said pumping means in response to said low pressure sensing means when the pressure of the fluid in said manifold falls below said low pressure sensing means threshold, whereby the pressure of said fluid in said manifold is increased to above said low pressure sensing means threshold, and vent control means for closing said vent return means and opening said vent return means in response to said high pressure sensing means when the pressure of the fluid in said manifold exceeds said high pressure sensing means threshold, whereby the pressure of said fluid in said manifold is decreased to below said high pressure sensing means threshold wherein when the pressure sensed in said manifold is between said high and low pressure sensing means thresholds, said pumping means is deenergized and said vent return means is closed.

2. A fluid supply system according to claim 1 further comprising; said fluid supply system adapted for drawing fluid from more than one reservoir and said system further having a fluid source switching means for switching from one of the reservoirs to another of the reservoirs upon depletion of the fluid from one of the reservoirs.

3. A fluid supply system for controlling the pressure of fluid delivered from a fluid reservoir, comprising:

means for pumping the fluid from the reservoir, a manifold, a pump outlet conduit communicating said pumping means with said manifold, an outlet conduit communicating with said manifold for discharging the fluid, a vent return line communicating said manifold with the reservoir for returning the fluid from said manifold to the reservoir, a high pressure switch communicating with said manifold, said high pressure switch having a switching threshold, a low pressure switch communicating with said manifold, said low pressure switch having a switching threshold which is less than said sensing threshold of said high pressure sensing means, control means for said pumping means for energizing said pumping means in response to said low pressure switch when the pressure of the fluid in said manifold falls below said low pressure switch threshold, whereby the pressure of said fluid in said manifold is increased to above said low pressure switch threshold, and vent control means for closing said vent return line and opening said vent return line in response to said high pressure switch when the pressure of the fluid in said manifold exceeds said high pressure switch threshold, whereby the pressure of said fluid in said manifold is decreased to below said high pressure switch threshold wherein when the pressure sensed in said manifold is between said high and low pressure sensing means thresholds, said pumping means is deenergized and said vent return means is closed.

4. A fluid supply system according to claim 3 wherein said high pressure switch threshold is adjustable.

5. A fluid supply system according to claim 3 wherein said low pressure switch threshold is adjustable.

6. A fluid supply system according to claim 3 further comprising a vent relief pressure valve in said vent return line, said vent relief pressure valve restricting the flow of the fluid in said vent return line.

7. A fluid supply system according to claim 3 wherein the restriction provided by said vent relief pressure valve is variable.

8. A fluid supply system according to claim 3 wherein said vent control means comprises; a pump vent control valve having a pneumatically actuated cylinder which actuates a fluid valve in said vent return line, and a vent control switch actuated by a signal from said high pressure switch and having a valve which controls the delivery of compressed air to said pump vent control valve cylinder.

9. A fluid supply system according to claim 3 further comprising a check valve in said pump outlet conduit to prevent reversed flow of the fluid in said pump outlet conduit.

10. A fluid supply system according to claim 3 further comprising a manual actuation circuit permitting bypassing of said manifold, said manual actuation circuit comprising, a first valve in said pump outlet conduit, a bypass conduit connecting said pump outlet conduit with said outlet conduit, a second valve in said bypass conduit, and a third valve in said outlet conduit.

11. A fluid supply system according to claim 3 further comprising; said fluid supply system adapted to drawing fluid from more than one reservoir and said system further having a fluid source switching means for switching from one of the reservoirs to another of the reservoirs upon depletion of the fluid from one of the reservoirs.

12. A fluid supply system according to claim 3 wherein both said high pressure switch and said low pressure switch are connected to said manifold such that the distance of the flow path therebetween is three inches or less.

13. A fluid supply system according to claim 3 wherein said pumping means comprises a pneumatically powered pump.

14. A fluid supply system according to claim 13 wherein said control means for said pumping means comprises; a pump control switch which controls the delivery of compressed air to said pump, said pump control switch including a pump control switch solenoid which is electrically connected with said low pressure switch to control the operation of a pump control switch valve.

15. A fluid supply system according to claim 3 wherein said high pressure switch and said low pressure-switch are integrated into a single housing.

16. A fluid supply system according to claim 15 wherein said single housing defines a fitting which communicates with said manifold, said fitting having an internal bore having a diameter greater than approximately 0.1875 inch.

17. A fluid supply system for controlling the pressure of fluid delivery from either a first or a second fluid reservoir comprising, first pumping means for pumping the fluid from the first reservoir, second pumping means for pumping the fluid from the second reservoir, a manifold, a first pump outlet conduit communicating said first pumping means with said manifold, a second pump outlet conduit communicating said second pumping means with said manifold, an outlet conduit communicating with said manifold for discharging the fluid, a first vent return line communicating said manifold with the first reservoir for returning the fluid from said manifold to the first reservoir, a second vent return line communicating said manifold with the second reservoir for returning the fluid from said manifold to the second reservoir, a high pressure switch communicating with said manifold, said high pressure switch having a switching threshold, a low pressure switch communicating with said manifold, said low pressure switch having a switching threshold, control means for said first and second pumping means for energizing either of said first or second pumping means in response to said low pressure switch when the pressure of the fluid in said manifold falls below said low pressure switch threshold, whereby the pressure of said fluid in said manifold is increased to above said low pressure switch threshold, vent control means for closing said vent return line and opening said vent return line in response to said high pressure switch when the pressure of the fluid in said manifold exceeds said high pressure switch threshold, whereby the pressure of said fluid in said manifold is decreased to below said high pressure switch threshold, and fluid source switching means for switching from one of the reservoirs to the other of the reservoirs upon depletion of the fluid from a reservoir.

18. A fluid supply system according to claim 17 wherein said fluid source switching means comprises;

a first pilot valve which includes a pneumatic valve which switches in response to fluid pressure in said first pump outlet conduit, a second pilot valve which includes a pneumatic valve which switches in response to fluid pressure in said second pump outlet conduit, a first pilot signal line connected to said first pilot pneumatic valve, a second pilot signal line connected to said second pilot pneumatic valve, a pump selective valve which switches in response to the presence of air pressure in either of said first or second pilot signal lines to switch between controlling either said first or said second pumping means, and a vent selector valve which switches in response to the presence of air pressure in either of said first or second pilot signal lines to switch the return of fluid from said manifold to either of the first or second reservoir.

19. A fluid supply system according to claim 17 wherein said high pressure switch threshold is adjustable.

20. A fluid supply system according to claim 17 wherein said low pressure switch threshold is adjustable.

21. A fluid supply system according to claim 17 wherein said vent control means comprises; a pump vent control valve having a pneumatically actuated cylinder which actuates a fluid valve in said vent return line, and a vent control switch actuated by a signal from said high pressure switch and having a valve which controls the delivery of compressed air to said pump vent control valve cylinder.

22. A fluid supply system according to claim 17 further comprising a check valve in said pump outlet conduit to prevent reserved flow of the fluid in said pump outlet conduit.

23. A fluid supply system according to claim 17 further comprising a manual actuation circuit permitting bypassing of said manifold, said manual actuation circuit comprising, a pair of first valves in said pump outlet conduits, a pair of bypass conduits connecting said pump outlet conduits with said outlet conduit, a pair of second valves in said bypass conduits, and a third valve in said outlet conduit.

24. A fluid supply system according to claim 17 wherein both said high pressure switch and said low pressure switch are connected to said manifold such that the distance of the flow path therebetween is three inches or less.

25. A fluid supply system according to claim 17 further comprising a vent relief pressure valve in said vent return line, said vent relief pressure valve restricting the flow of the fluid in said vent return line.

26. A fluid supply system according to claim 25 wherein the restriction provided by said vent relief pressure valve is variable.

27. A fluid supply system according to claim 17 wherein said pumping means is a pneumatically powered pump.

28. A fluid supply system according to claim 27 wherein said pump control means for said pumping means comprises; a pump control switch which controls the delivery of compressed air to said pumps, said pump control switch including a pump control switch solenoid which is electrically connected with said low pressure switch to control the operation of a pump control switch valve.

29. A fluid supply system according to claim 17 wherein said high pressure switch and said low pressure switch are integrated into a single housing.

30. A fluid supply system according to claim 29 wherein said single housing defines a fitting which communicates with said manifold, said fitting having an internal bore having a diameter greater than approximately 0.1875 inch.

31. A fluid supply system for controlling the pressure of fluid delivered from a fluid reservoir, comprising:

means for pumping the fluid from the reservoir, a manifold, a pump outlet conduit communicating said pumping means with said manifold, an outlet conduit communicating with said manifold for discharging the fluid, a vent return line communicating said manifold with the reservoir for returning the fluid from said manifold to the reservoir, a vent relief pressure valve in said vent return line, said vent relief pressure valve restricting the flow of the fluid in said vent return line, a high pressure switch communicating with said manifold, said high pressure switch having a switching threshold, a low pressure switch communicating with said manifold, said low pressure switch having a switching threshold, control means for said pumping means for energizing said pumping means in response to said low pressure switch when the pressure of the fluid in said manifold falls below said low pressure switch threshold, whereby the pressure of said fluid in said manifold is increased to above said low pressure switch threshold, and vent control means for closing said vent return line and opening said vent return line in response to said high pressure switch when the pressure of the fluid in said manifold exceeds said high pressure switch threshold, whereby the pressure of said fluid in said manifold decreased to below said high pressure switch threshold.

32. A fluid supply system for controlling the pressure of fluid delivered from a fluid reservoir, comprising:

a pneumatically powered pump for pumping the fluid from the reservoir, a manifold, a pump outlet conduit communicating said pump with said manifold, an outlet conduit communicating with said manifold for discharging the fluid, a vent return line communicating said manifold with the reservoir for returning the fluid from said manifold to the reservoir, a high pressure switch communicating with said manifold, said high pressure switch having a switching threshold, a low pressure switch communicating with said manifold, said low pressure switch having a switching threshold, control means for said pump for energizing said pump in response to said low pressure switch when the pressure of the fluid in said manifold falls below said low pressure switch threshold, whereby the pressure of said fluid in said manifold is increased to above said low pressure switch threshold, said control means including a pump control switch which controls the delivery of compressed air to said pump, said pump control switch including a pump control switch solenoid which is electrically connected with said low pressure switch to control the operation of a pump control switch valve, and vent control means for closing said vent return line and opening said vent return line in response to said high pressure switch when the pressure of the fluid in said manifold exceeds said high pressure switch threshold, whereby the pressure of said fluid in said manifold decreased to below said high pressure switch threshold.

33. A fluid supply system for controlling the pressure of fluid delivered from a fluid reservoir, comprising:

means for pumping the fluid from the reservoir, a manifold, a pump outlet conduit communicating said pumping means with said manifold, an outlet conduit communicating with said manifold for discharging the fluid, a vent return line communicating said manifold with the reservoir for returning the fluid from said manifold to the reservoir, a high pressure switch communicating with said manifold, said high pressure switch having a switching threshold, a low pressure switch communicating with said manifold, said low pressure switch having a switching threshold, control means for said pumping means for energizing said pumping means in response to said low pressure switch when the pressure of the fluid in said manifold falls below said low pressure switch threshold, whereby the pressure of said fluid in said manifold is increased to above said low pressure switch threshold, and vent control means for closing said vent return line and opening said vent return line in response to said high pressure switch when the pressure of the fluid in said manifold exceeds said high pressure switch threshold, whereby the pressure of said fluid in said manifold decreased to below said high pressure switch threshold, said vent control means including a pump vent control valve having a pneumatically actuated cylinder which actuates a fluid valve in said vent return line, and a vent control switch actuated by a signal from said high pressure switch and having a valve which controls the delivery of compressed air to said pump vent control valve cylinder.

34. A fluid supply system for controlling the pressure of fluid delivered from a fluid reservoir, comprising:

means for pumping the fluid from the reservoir, a manifold, a pump outlet conduit communicating said pumping means with said manifold, an outlet conduit communicating with said manifold for discharging the fluid, a vent return line communicating said manifold with the reservoir for returning the fluid from said manifold to the reservoir, a high pressure switch communicating with said manifold, said high pressure switch having a switching threshold, a low pressure switch communicating with said manifold, said low pressure switch having a switching threshold, control means for said pumping means for energizing said pumping means in response to said low pressure switch when the pressure of the fluid in said manifold falls below said low pressure switch threshold, whereby the pressure of said fluid in said manifold is increased to above said low pressure switch threshold, and vent control means for closing said vent return line and opening said vent return line in response to said high pressure switch when the pressure of the fluid in said manifold exceeds said high pressure switch threshold, whereby the pressure of said fluid in said manifold decreased to below said high pressure switch threshold, and a manual actuation circuit permitting bypassing of said manifold, said manual actuation circuit including a first valve in said pump outlet conduit, a bypass conduit connecting said pump outlet conduit with said outlet conduit, a second valve in said bypass conduit, and a third valve in said outlet conduit.

35. A fluid supply system for controlling the pressure of fluid delivery from either a first or a second fluid reservoir, comprising:

first pumping means for pumping the fluid from the first reservoir, second pumping means for pumping the fluid from the second reservoir, a manifold, a first pump outlet conduit communicating said first pumping means with said manifold, a second pump outlet conduit communicating said second pumping means with said manifold, an outlet conduit communicating with said manifold for discharging the fluid, a first vent return line communicating said manifold with the first reservoir for returning the fluid from said manifold to the first reservoir, a second vent return line communicating said manifold with the second reservoir for returning the fluid from said manifold to the second reservoir, a high pressure switch communicating with said manifold, said high pressure switch having a switching threshold, a low pressure switch communicating with said manifold, said low pressure switch having a switching threshold, control means for said first and second pumping means for energizing either of said first or second pumping means in response to said low pressure switch when the pressure of the fluid in said manifold falls below said low pressure switch threshold, whereby the pressure of said fluid in said manifold is increased to above said low pressure switch threshold, vent control means for closing said vent return line and opening said vent return line in response to said high pressure switch when the pressure of the fluid in said manifold exceeds said high pressure switch threshold, whereby the pressure of said fluid in said manifold is decreased to below said high pressure switch threshold, and fluid source switching means for switching from one of the reservoirs to the other of the reservoirs upon depletion of the fluid from a reservoir, said fluid source switch means including, a first pilot valve which includes a pneumatic valve which switches in response to fluid pressure in said first pump outlet conduit, a second pilot valve which includes a pneumatic valve which switches in response to fluid pressure in said second pump outlet conduit, a first pilot signal line connected to said first pilot pneumatic valve, a second pilot signal line connected to said second pilot pneumatic valve, a pump selective valve which switches in response to the presence of air pressure in either of said first or second pilot signal lines to switch between controlling either said first or said second pumping means, and a vent selector valve which switches in response to the presence of air pressure in either of said first or second pilot signal lines to switch the return of fluid from said manifold to either of the first or second reservoir.

36. A fluid supply system for controlling the pressure of fluid delivery from either a first or a second fluid reservoir, comprising:

first pumping means for pumping the fluid from the first reservoir, second pumping means for pumping the fluid from the second reservoir, a manifold, a first pump outlet conduit communicating said first pumping means with said manifold, a second pump outlet conduit communicating said second pumping means with said manifold, an outlet conduit communicating with said manifold for discharging the fluid, a first vent return line communicating said manifold with the first reservoir for returning the fluid from said manifold to the first reservoir, a first vent relief pressure valve in said first vent return line, said first vent relief pressure valve restricting the flow of the fluid in said first vent return line wherein the restriction provided by said first vent relief pressure valve is variable, a second vent return line communicating said manifold with the second reservoir for returning the fluid from said manifold to the second reservoir, a second vent relief pressure valve in said second vent return line, said second vent relief pressure valve restricting the flow of the fluid in said second vent return line wherein the restriction provided by said second vent relief pressure is variable, a high pressure switch communicating with said manifold, said high pressure switch having a switching threshold, a low pressure switch communicating with said manifold, said low pressure switch having a switching threshold, control means for said first and second puming means for energizing either of said first or second pumping means in response to said low pressure switch when the pressure of the fluid in said manifold falls below said low pressure switch threshold, whereby the pressure of said fluid in said manifold is increased to above said low pressure switch threshold.

37. A fluid supply system for controlling the pressure of fluid delivery from either a first or a second fluid reservoir, comprising:

a first pneumatically powered pump for pumping the fluid from the first reservoir, a second pneumatically powered pump for pumping the fluid from the second reservoir, a manifold, a first pump outlet conduit communicating said first pump with said manifold, a second pump outlet conduit communicating said second pump with said manifold, an outlet conduit communicating with said manifold for discharging the fluid, a first vent return line communicating said manifold with the first reservoir for returning the fluid from said manifold to the first reservoir, a second vent return line communicating said manifold with the second reservoir for returning the fluid from said manifold to the second reservoir, a high pressure switch communicating with said manifold, said high pressure switch having a switching threshold, a low pressure switch communicating with said manifold, said low pressure switch having a switching threshold, and control means for said first and second pumps for energizing either of said first or second pumps in response to said low pressure switch when the pressure of the fluid in said manifold falls below said low pressure switch threshold, whereby the pressure of said fluid in said manifold is increased to above said low pressure switch threshold, said control means including a pump control switch which controls the delivery of compressed air to said pumps, said pump control switch including a pump control switch solenoid which is electrically connected with said low pressure switch to control the operation of a pump control switch valve.

38. A fluid supply system for controlling the pressure of fluid delivery from either a first or a second fluid reservoir, comprising:

first pumping means for pumping the fluid from the first reservoir, second pumping means for pumping the fluid from the second reservoir, a manifold, a first pump outlet conduit communicating said first pumping means with said manifold, a second pump outlet conduit communicating said second pumping means with said manifold, an outlet conduit communicating with said manifold for discharging the fluid, a first vent return line communicating said manifold with the first reservoir for returning the fluid from said manifold to the first reservoir, a second vent return line communicating said manifold with the second reservoir for returning the fluid from said manifold to the second reservoir, a high pressure switch communicating with said manifold, said high pressure switch having a switching threshold, a low pressure switch communicating with said manifold, said low pressure switch having a switching threshold, control means for said first and second pumping means for energizing either of said first or second pumping means in response to said low pressure switch when the pressure of the fluid in said manifold falls below said low pressure switch threshold, whereby the pressure of said fluid in said manifold is increased to above said low pressure switch threshold, vent control means for closing said vent return line and opening said vent return line in response to said high pressure switch when the pressure of the fluid in said manifold exceeds said high pressure switch threshold, whereby the pressure of said fluid in said manifold is decreased to below said high pressure switch threshold, said vent control means including a pump vent control valve having a pneumatically actuated cylinder which actuates a fluid valve in said vent return line, and a vent control switch actuated by a signal from said high pressure switch and having a valve which controls the delivery of compressed air to said pump vent control valve cylinder, and fluid source switching means for switching from one of the reservoirs to the other of the reservoirs upon depletion of the fluid from a reservoir.

* * * * *